US006058637A

United States Patent [19]

Duncan

[11] Patent Number: 6,058,637

[45] Date of Patent: May 9, 2000

[54] IMPRINTABLE TAPE WITH TEAR LINES DEFINING ASYMMETRICAL IDENTIFICATION BRACELETS

[75] Inventor: Julie A. Duncan, Lake Zurich, Ill.

[73] Assignee: Hollister Incorporated, Libertyville, Ill.

[21] Appl. No.: 09/299,540

[22] Filed: Apr. 26, 1999

[51] Int. Cl.[7] ..... G09F 3/14

[52] U.S. Cl. ..... 40/633; 40/665

[58] Field of Search ..... 40/633, 665

[56] References Cited

U.S. PATENT DOCUMENTS

| | | |
|---|---|---|
| 3,059,359 | 10/1962 | Goldammer et al. . |
| 3,467,246 | 9/1969 | Long et al. . |
| 3,800,450 | 4/1974 | Laugherty et al. . |
| 4,221,063 | 9/1980 | Charles et al. . |
| 4,285,146 | 8/1981 | Charles et al. . |
| 4,318,234 | 3/1982 | Charles et al. . |
| 4,783,917 | 11/1988 | Smith . |
| 4,914,843 | 4/1990 | DeWoskin . |
| 5,448,846 | 9/1995 | Peterson et al. . |
| 5,581,924 | 12/1996 | Peterson . |
| 5,799,426 | 9/1998 | Peterson . |

FOREIGN PATENT DOCUMENTS

| | | | |
|---|---|---|---|
| 164413 | 12/1933 | Switzerland | 40/665 |
| 169211 | 8/1934 | Switzerland | 40/665 |
| 5486 | 2/1913 | United Kingdom | 40/665 |

*Primary Examiner*—Cassandra H. Davis
*Attorney, Agent, or Firm*—Tilton Fallon Lungmus

[57] ABSTRACT

A machine-imprintable tape, most advantageously provided in roll or coil form, is disclosed. The tape has lines of weakness constituting tear lines that define a longitudinal series of asymmetric identification bracelets, each bracelet having a generally rectangular imprintable portion, an elongated strap portion at one end of the imprintable portion, and a connecting tab portion at the opposite end of the imprintable portion. The imprintable portion has a width equal to that of the tape; the strap and tab portions are substantially narrower and are arranged along one side edge of the tape to leave removable waste sections extending along only the opposite side edge of the tape. To control advancement of the tape through a printer, each waste section may be provided with a locator opening detectable by an optical sensor of the printer.

12 Claims, 1 Drawing Sheet

D
5
5

IMPRINTABLE TAPE WITH TEAR LINES DEFINING ASYMMETRICAL IDENTIFICATION BRACELETS

BACKGROUND AND SUMMARY

It is known to provide patient identification bracelets joined end-to-end in roll form so that such bracelets may be fed through a printer, such as a direct thermal printer or a thermal transfer printer. Following imprinting, each bracelet is separated from the roll and fitted about a patient's wrist or ankle. For example, U.S. Pat. No. 5,799,426 discloses a roll of tape of uniform width which may be fed through a computerized printer, the tape being in the form of separable sections joined end-to-end. After each bracelet is printed and separated from the remainder of the tape, its opposite ends may be adhered together to form a closed loop.

Each bracelet of U.S. Pat. No. 5,799,426 is of uniform width. While such width may be necessary in the central imprintable area to accommodate medical information, it is believed to be clearly undesirable along the strap portion of the bracelet because it reduces conformability, is visually objectionable, and is often likely to cause patient discomfort.

While bracelets are known that have relatively wide information-receiving portions and narrow strap portions (see, for example, U.S. Pat. Nos. 4,914,843, 5,581,924, 3,467,246), such bracelets have generally not been provided in roll form for use with machine printers because reliability and effectiveness of printer operations require tape of substantially uniform width. A possible alternative might be to provide a tape of uniform width with removable portions that could be detached from each side and discarded after the imprinting step; however, such procedures would tend to be time consuming and would largely offset the advantages conferred by automated processing. If, for example, the bracelet of U.S. Pat. No. 4,914,843 originated from a roll in which such bracelets were arranged in end-to-end series along a tape of uniform width, then users, following the printing of the bracelets of such a roll, would be required to grasp and strip away narrow waste areas along opposite sides of the strap portion of each bracelet in addition to separating the ends of successive bracelets of the series.

One aspect of this invention therefore lies in the recognition that such disadvantages may be eliminated or greatly reduced by providing separable bracelets in tape form with each bracelet being asymmetrical in shape. More specifically, each bracelet has an imprintable portion extending the full width of the tape and relatively narrow strap and tab portions offset at opposite ends of the imprintable portion. The strap and tab portions are aligned along one side edge of the tape, leaving relatively wide and easily graspable and removable waste sections extending only along the opposite side edge of the tape.

Such a construction yields significant advantages. When the waste sections are removed, each bracelet has relatively narrow strap and tab portions that compared to a machine-imprintable band of uniform width, improve its appearance and make it more comfortable to wear. Removal of the waste sections is facilitated because they extend along only one side of the tape and are relatively wide, approximating the width of the strap portions themselves, and are therefore easily grasped for removal. Further, because of their substantial width, each waste section may be provided with a sensor opening of the type used by conventional tape printers for controlling the automatic advancement and location of tape through the machines. Such openings in no way weaken the final bracelets because the sensor openings are not located in their strap portions but instead are disposed along the waste sections that are discarded after the tapes have been printed.

Other features, advantages, and objects of the invention will become apparent from the specification and drawings.

DRAWINGS

DETAILED DESCRIPTION OF AN EMBODIMENT OF THE INVENTION

Figures 1, 2, 3, 4, 5, 6:
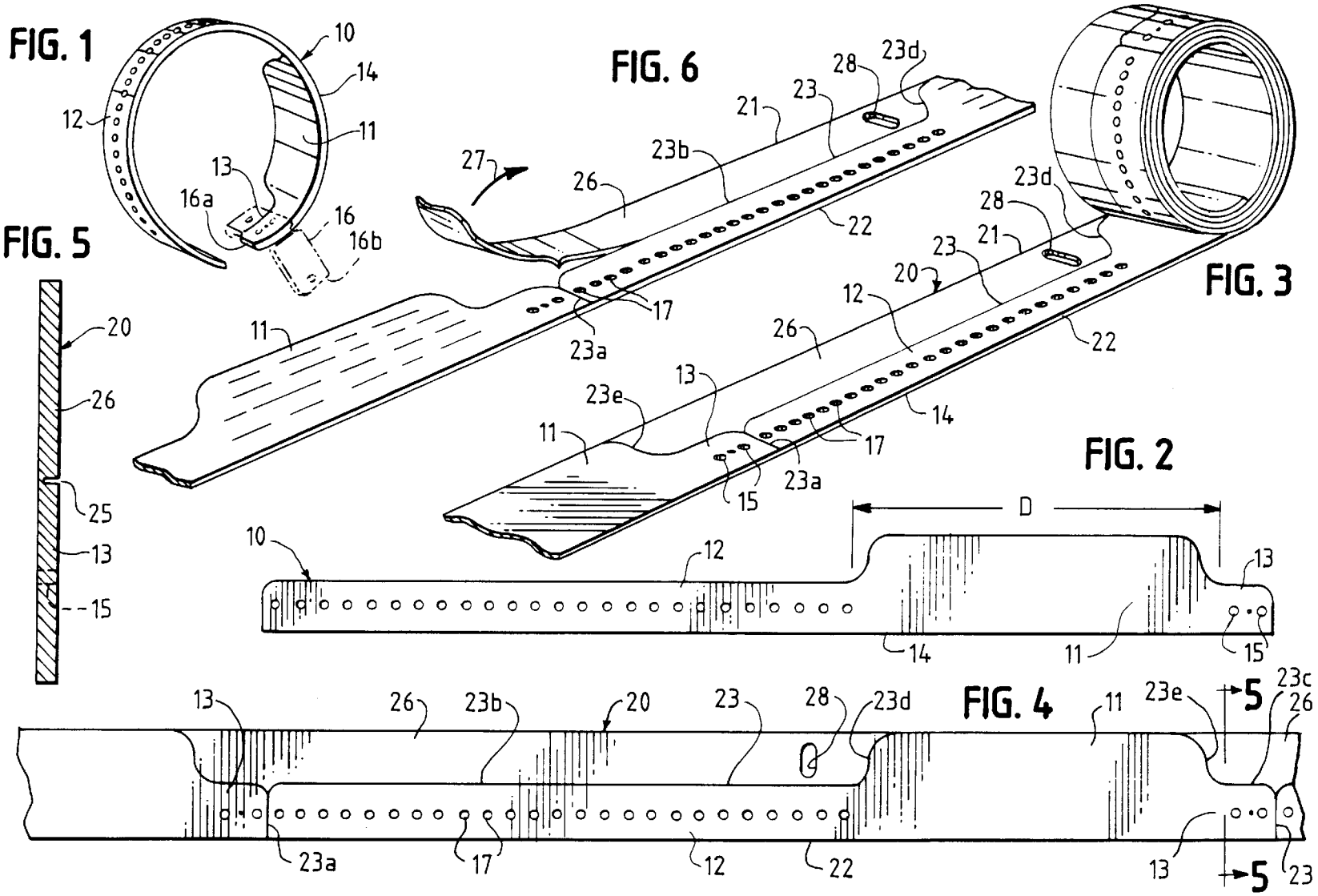
FIG. 1 is a perspective view of an identification bracelet embodying the invention.
FIG. 2 is a plan view of the bracelet in flat condition.
FIG. 3 is a perspective view of a tape roll from which bracelets of asymmetric configuration are to be detached following a printing operation.
FIG. 4 is a plan view of a stretch of unrolled tape showing the tear lines defining one complete bracelet and a removable waste section.
FIG. 5 is an enlarged cross sectional view taken along line 5—5 of FIG. 4.
FIG. 6 is a fragmentary perspective view illustrating the steps of separating successive bracelets from each other and removing a waste section alongside each bracelet following the imprinting of such bracelets.

FIGS. 1 and 2 illustrate an identification bracelet 10 of asymmetric outline embodying the invention. The bracelet is formed from a strip of thin, tough, flexible and stretch-resistant material providing an outer surface capable of receiving (or generating) and retaining indicia. A variety of materials having such characteristics are well known in the art. One such material believed to be particularly effective is a tri-laminate of synthetic paper, polyester and textured polyethylene, but other materials having similar properties may be used. Also, as well known in the art, such materials may be surface treated to make them thermally sensitive, allowing indicia to be created on or within the bracelet by heat. In that connection, it is to be understood that the terms "imprint" and "imprintable" are used herein to refer to a surface that may be acted upon by conventional means to provide visible characters from which useful information may be derived, either visually or by means of scanners. If the printer is of the thermal type, the imprint may take the form of a pigment that is transferred to the tape through the localized application of heat, or it may be in the form of a color change in the thermally-sensitive coating or surface layer of the tape itself, resulting in a thermally-generated imprint in which no pigment is transferred. Since such imprinting techniques and equipment are well known and widely available, further discussion is believed unnecessary herein.

Referring to FIG. 2, the bracelet includes an intermediate imprintable portion 11, an elongated strap portion 12, and a tab portion 13. It will be observed that the strap and tab portions are considerably narrower than the imprintable portion. In the illustration given, the strap and tab portions are each approximately one half the width of the imprintable portion. Of particular importance is the fact that one side edge 14 of the bracelet is straight so that in planar view the bracelet is of asymmetric outline, the strap and tab portions being aligned along one side edge of the bracelet and the imprintable portion 11 projecting laterally beyond strap portion 12 and tab portion 13 along the opposite side of the bracelet.

To maximize patient comfort, the length of the imprintable portion 11 should be limited in relation to that of the relatively narrow strap and tab portions 12 and 13. In general, for an adult-size bracelet the length of the imprintable portion 11 should not exceed 40% of the length of the bracelet as a whole. Preferably such length should be 35% or less. For an adult bracelet as shown, one having a total length of approximately 11.3 inches, the length D of the imprintable portion may be approximately 3.5 inches. The width of the imprintable portion may fall within the range of about 1 to 1.25 inches.

Any suitable means may be used to join the ends of the bracelet after it has been looped about a patient's wrist or ankle. The connection may be adhesive or mechanical, although the latter is generally preferred for security purposes and other reasons as well. Plastic and metal clasps of various types are known and may be used. In the illustration given, tab portion 13 is provided with openings 15 to receive the anchoring pins of a plastic fastener 16 depicted in phantom in FIG. 1. Such fastener is disclosed in co-pending application Ser. No. 08/847,028, filed Jun. 12, 1997, and includes hinged base portion 16*a* and cover portion 16*b* provided with locking elements which securely engage each other and clamp the strap and tab portions together in selected positions of adjustment when the clasp is closed. As shown in the drawings, the strap portion 12 has a series of spaced openings 17 extending along its longitudinal midline to receive one or more locking pins provided by the clasp, thereby securely locking the ends of the bracelet against relative movement.

The bracelets are supplied in tape form, such tape being designated by the numeral 20 in FIGS. 3 and 4. The tape has parallel side edges 21 and 22 and is therefore of uniform width throughout its full length. It is supplied to the user in rolled or coiled form to be processed by a conventional printer that may be computer controlled to apply or generate imprints from stored data. The tape has lines of weakness 23 that constitute tear lines defining in outline each of the identification bracelets 10. Such bracelets are arranged in longitudinal alignment with tear line portions 23*a* extending between the ends of tab portions 13 and the beginning of strap portions 12. It will be observed that the generally rectangular imprintable portions 11 extend the full width of the tape and that strap and tab portions 12, 13 are substantially narrower, preferably about one half the width of the tape. The strap, tab and imprintable portions all have edges in longitudinal alignment along one side edge 22 of the tape. The opposite longitudinal limits of the strap and tab portions are defined by tear line portions 23*b* and 23*c* extending along the tape's midline. The lines of weakness also extend outwardly at 23*d* and 23*e* to define the ends of the imprintable portions 11.

While the lines of weakness may take the form of perforations, it is preferred that such lines be scored or kiss-cut so as to leave a smooth edge following a tearing operation. FIG. 5 illustrates such a score or cut 25 through nearly the full thickness of the tape, thereby defining line of weakness 23.

The lines of weakness 23 not only define outer limits for the strap, tab and imprintable portions but also define waste sections 26 that extend alongside strap and tab portions 12 and 13. Since the bracelets are asymmetrical in shape, waste sections 26 are disposed along only one side of the tape. They are relatively wide, approximating the width of the strap and tab portions, and may be easily grasped for removal and torn away following imprinting as represented by arrow 27 in FIG. 6. At one end of each waste section, preferably the end adjacent to that end of the strap portion merging with the indicia-receiving portion of a bracelet, is a locator opening 28 for detection by an optical sensor of a printer for automatically controlling the intermittent advancement and positioning of the tape for imprinting. Since the locator openings are confined to the waste sections 26 and are outside the limits of the bracelets 10, they do not weaken or otherwise affect the bracelets in their final form. Either before or after removal of waste sections 26, successive bracelets may be detached from each other along tear line portion 23*a*.

While in the foregoing I have disclosed an embodiment of the invention in considerable detail for purposes of illustration, it will be understood by those skilled in the art that many of these details may be varied without departing from the spirit and scope of the invention.

What is claimed is:

1. A flexible, substantially non-stretchable, machine-imprintable tape having parallel side edges; said tape having lines of weakness constituting tear lines defining in outline a longitudinal series of identification bracelets; each bracelet having a generally rectangular imprintable portion, an elongated strap portion at one end of said imprintable portion, and a connecting tab portion at the opposite end of said imprintable portion; said imprintable portion being of a width equal to the width of said tape and said strap and tab portions each having a width substantially less than that of said tape; each bracelet being asymmetrical in outline with said strap and tab portions each having a longitudinal edge aligned with one of said side edges of said tape and having an opposite longitudinal edge defined by one of said lines of weakness and extending generally along the longitudinal midline of said tape.

2. The tape of claim 1 in which said lines of weakness also define waste sections alongside said strap and tab portions that are separable and discardable after each bracelet has been separated from said tape.

3. The tape of claim 2 in which each waste section extends along a strap portion of one bracelet and a tab portion of an adjacent bracelet of said series.

4. The tape of claim 1, 2 or 3 in which said tape is in coil form.

5. The tape of claim 2 or 3 in which each waste section includes a locator opening extending therethrough.

6. The tape of claim 4 in which said locator opening of each waste section is disposed adjacent one end of said waste section.

7. The tape of claim 1 in which said tab portion of each bracelet is provided with attachment means for orienting and connecting said bracelet to a locking clip.

8. The tape of claim 6 in which said attachment means comprises at least one aperture extending through said tab portion.

9. The tape of claim 1 in which said lines of weakness constitute score lines extending partially through the thickness of said tape from at least one side thereof.

10. The tape of claim 1 in which said strap portion of each bracelet has a multiplicity of uniformly-spaced openings extending along the longitudinal midline thereof.

11. A patient identification bracelet formed of flexible, substantially non-stretchable, machine-imprintable sheet material; said bracelet having a generally rectangular imprintable portion; an elongated strap portion at one end of said imprintable portion, and a connecting tab portion at the opposite end of said imprintable portion; said strap and tab portions each having a width substantially less than that of said imprintable portion; said bracelet being asymmetrical in outline with said strap and tab portions each having a longitudinal edge aligned with a longitudinal side edge of said imprintable portion and having an opposite side edge spaced substantially inwardly from the opposite side edge of said imprintable portion; said opposite side edges of said strap and tab portions being generally aligned with the longitudinal midline of said imprintable portion.

12. The bracelet of claim 11 in which said imprintable portion has a length no greater than about 40% of the length of said bracelet.

* * * * *